US008258688B2

(12) United States Patent
Huang et al.

(10) Patent No.: US 8,258,688 B2
(45) Date of Patent: Sep. 4, 2012

(54) STYLABLE LAMP WITH BULB INCLUDING MODEL

(76) Inventors: Tsun-Yu Huang, Changhua County (TW); Cheng-Yi Huang, Changhua County (TW)

( * ) Notice: Subject to any disclaimer, the term of this patent is extended or adjusted under 35 U.S.C. 154(b) by 36 days.

(21) Appl. No.: 12/912,877

(22) Filed: Oct. 27, 2010

(65) Prior Publication Data

US 2012/0104928 A1 May 3, 2012

(51) Int. Cl.
*H01J 5/48* (2006.01)
*H01J 5/50* (2006.01)

(52) U.S. Cl. ..... 313/318.01; 313/493; 313/634

(58) Field of Classification Search ..... 313/493, 313/510, 512, 634, 318.01, 318.04, 318.09, 313/318.1, 318.12
See application file for complete search history.

(56) References Cited

U.S. PATENT DOCUMENTS

| | | | | |
|---|---|---|---|---|
| 5,683,239 | A * | 11/1997 | Cardosi | 431/291 |
| 6,224,244 | B1 * | 5/2001 | Burys | 362/489 |
| 7,001,053 | B1 * | 2/2006 | Chieh et al. | 362/500 |
| 2006/0250802 | A1 * | 11/2006 | Herold | 362/362 |
| 2008/0055893 | A1 * | 3/2008 | Au et al. | 362/188 |
| 2008/0074873 | A1 * | 3/2008 | Lin | 362/235 |
| 2008/0266866 | A1 * | 10/2008 | Tsai | 362/294 |
| 2010/0134047 | A1 * | 6/2010 | Hasnain | 315/302 |

* cited by examiner

*Primary Examiner* — Anh Mai
*Assistant Examiner* — Kevin Quarterman
(74) *Attorney, Agent, or Firm* — Muncy, Geissler, Olds & Lowe, PLLC

(57) ABSTRACT

A stylable lamp with bulb including model of the present invention includes a luminous base, a bulb, and a connecting portion. The bulb includes a model and a covering layer. The covering layer is made of transparent material. The model is embedded in the covering layer substantially. The model has an optical property different from that of the covering layer. As such, patterns and sculptures can be provides with the model. A smooth outer surface can be formed with the covering layer. An artistic lamp provided by the present invention can be cleaned up easily. The connecting portion connects the holder and a lamp adapter together and includes a scalable conjunction portion which is able to keep electric power supply continuing when position of the holder is adjusted.

10 Claims, 6 Drawing Sheets

STYLABLE LAMP WITH BULB INCLUDING MODEL

BACKGROUND OF THE INVENTION

1. Field of the Invention

The present invention relates to a lamp which can be designed for styling.

2. Description of the Prior Art

Some conventional lamps have lampshades for styling or pattern designing. The lampshades are exposed in air directly. As such, the appearance of the lampshades may be damaged by ageing, crashing or oxidizing. Besides, dust may be piled up in grooves or slits of the lampshades, so that the lampshades can be hardly cleaned up. The brightness of light emitted from the lampshade is decreased.

The present invention is, therefore, arisen to obviate or at least mitigate the above mentioned disadvantages.

SUMMARY OF THE INVENTION

The main object of the present invention is to provide a stylable lamp which can be easily cleaned up.

To achieve the above and other objects, a stylable lamp of the present invention includes a luminous base, a bulb, and a connecting portion.

The luminous base includes a holder and a luminary. The luminary is disposed on the holder. The luminary is adapted for electric power received from the holder to drive so as to illuminate light along an axis.

The bulb is disposed on the holder. The luminary is substantially enclosed by the holder and the bulb. The bulb includes a model and a covering layer which are both solid. The model is embedded in the covering layer. The covering layer is made of transparent material. The model has an optical property different from an optical property of the covering layer.

The connecting portion comprises a threaded portion and a conjunction portion. The conjunction portion is scalable. The conjunction portion and the holder are electrically connected with the threaded portion respectively. The conjunction portion is located between a bottom end of the threaded portion and a lamp adapter which is able to be connected with a socket. The threaded portion is able to be screwed with the lamp holder.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figures 1, 1A:
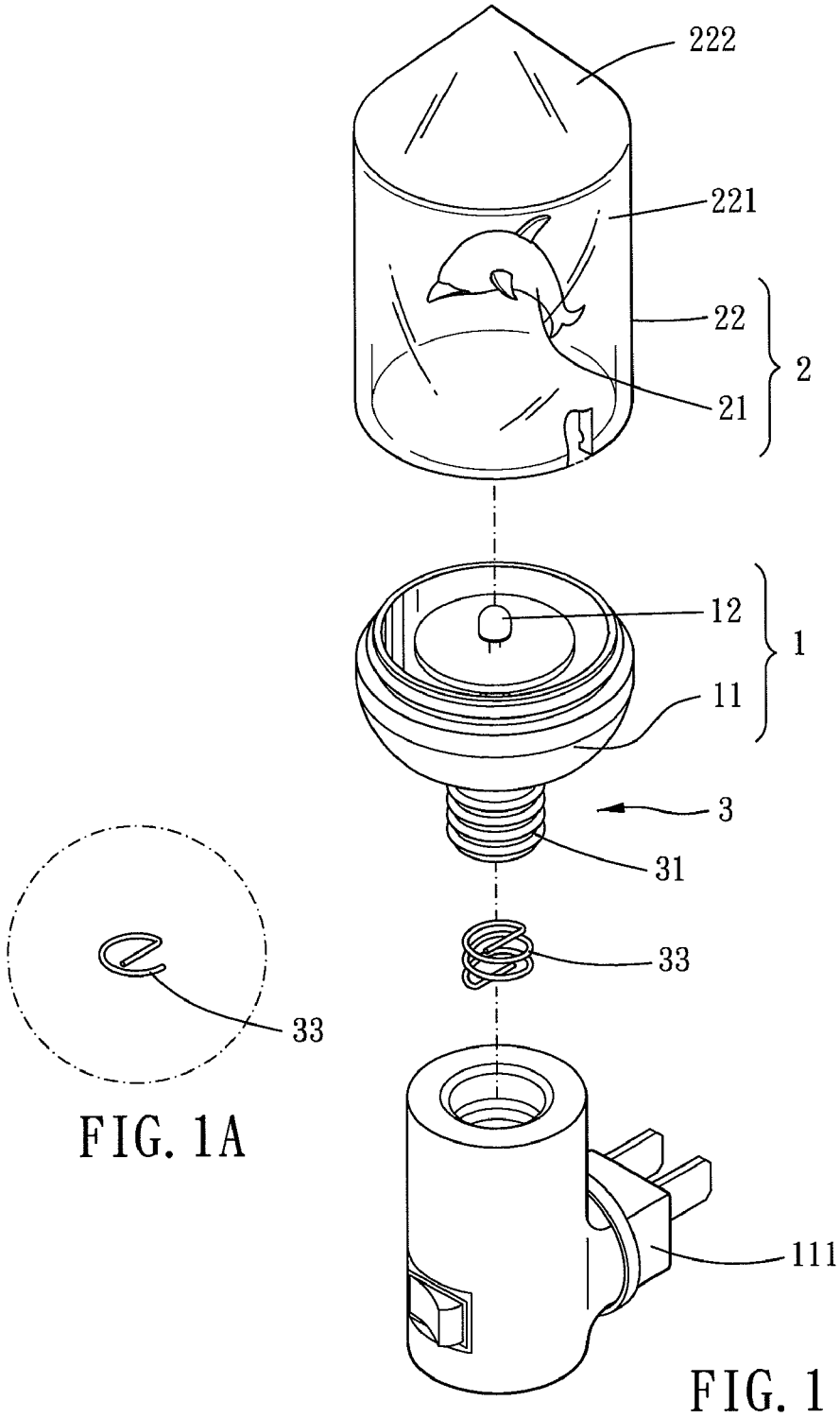
FIG. 1 is a breakdown drawing showing a first embodiment of the present invention.
FIG. 1A is a stereogram showing a leaf in a first embodiment of the present invention.
Figure 2:
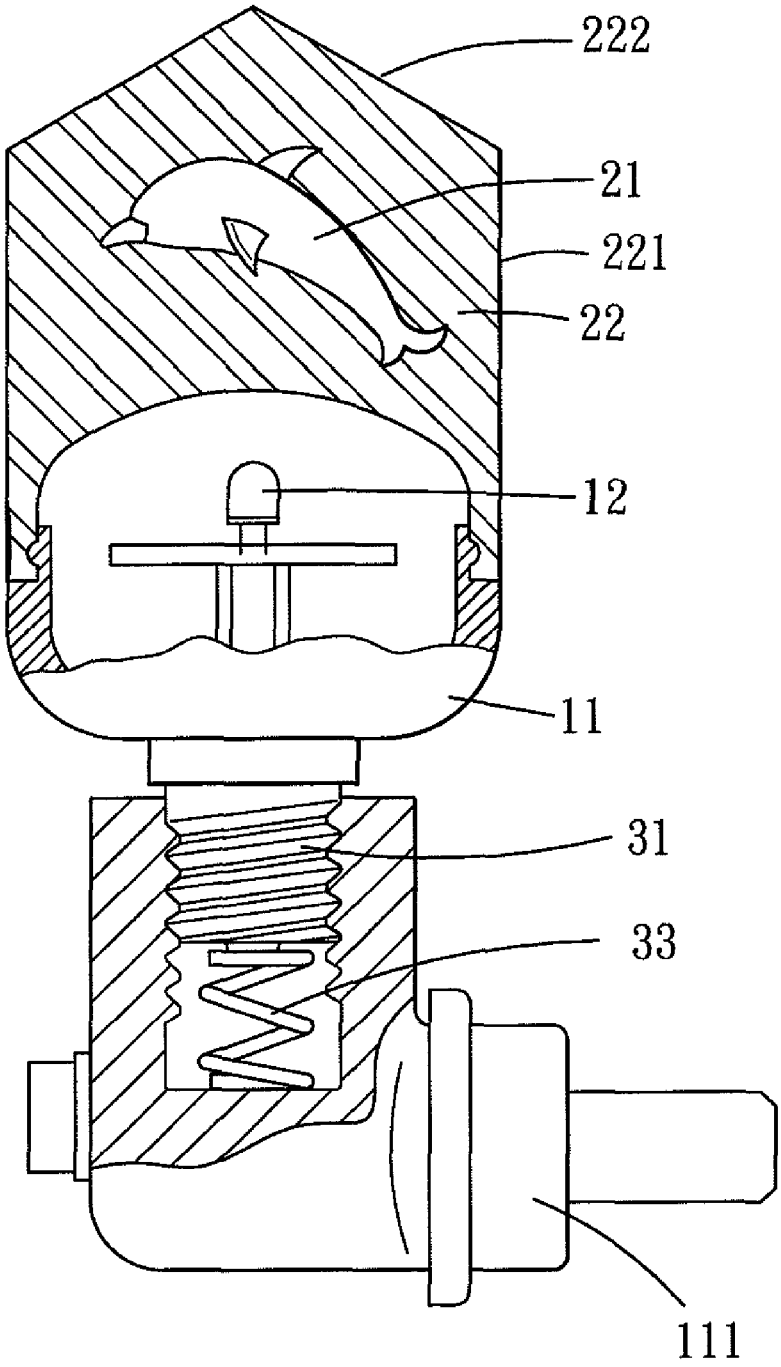
FIG. 2 is a profile showing a first embodiment of the present invention.
Figure 3:
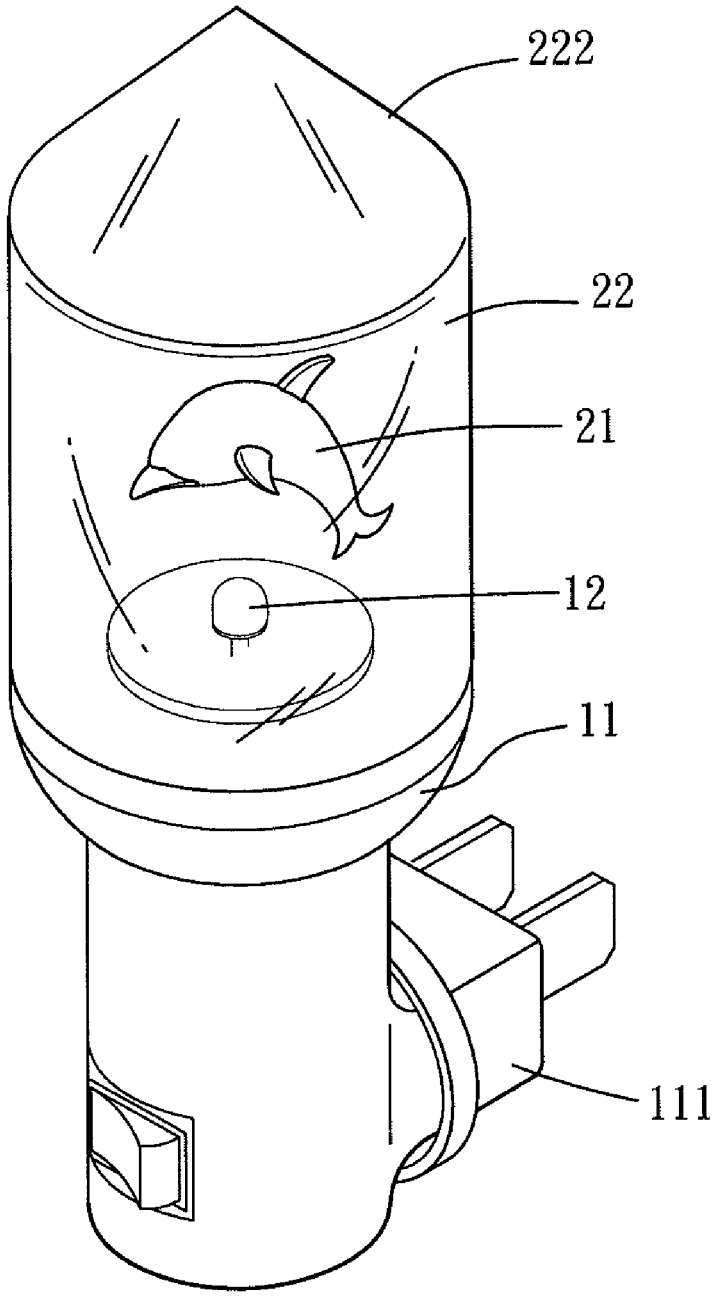
FIG. 3 is a combination drawing showing a first embodiment of the present invention.

Please refer to FIG. 1 to FIG. 3 for a first embodiment of the present invention. The lamp of the present embodiment includes a luminous base 1, a bulb 2, and a connecting portion 3.

The luminous base 1 includes a holder 11 and a luminary 12. The luminary 12 is disposed on the holder 11. The luminary 12 is adapted for electric power received from the holder 11 to drive so as to illuminate light along an axis. Preferably, the luminary 12 is a light emitting diode. The holder can be equipped on a lamp adapter 111. The lamp adapter 111 may have a rotating mechanism so as to be rotatably inserted in a socket.

The bulb 2 is disposed on the holder 11. The luminary 12 is substantially enclosed by the holder 11 and the bulb 2. Preferably, the bulb 2 has an annular groove engaged with the holder 11. As such, the bulb 2 is able to rotate about the axis with respect to the holder 11. In other possible embodiments of the present invention, the bulb 2 may be firmly disposed on the holder 11.

The bulb 2 includes a model 21 and a covering layer 22 which are both solid. The model 21 is embedded in the covering layer 22 substantially. The covering layer 22 is made of transparent material. At least one optical property of the model 21 is different from that of the covering layer 22. Optical properties of an object mean transmittance, refractive index and reflectance of the object. For instance, the model 21 may has transmittances with respect to red beam and green beam lower than those of the covering layer 22. As such, the model 21 will show up with blue color. In practice, the material of the model 21 is different from that of the covering layer 22. In another practical example, the model 21 and the covering layer 22 may be made from the same material, but only the material of the model 21 is intermixed with pigment. As such, the model 21 can be shown up with a predetermined color.

Figure 4:
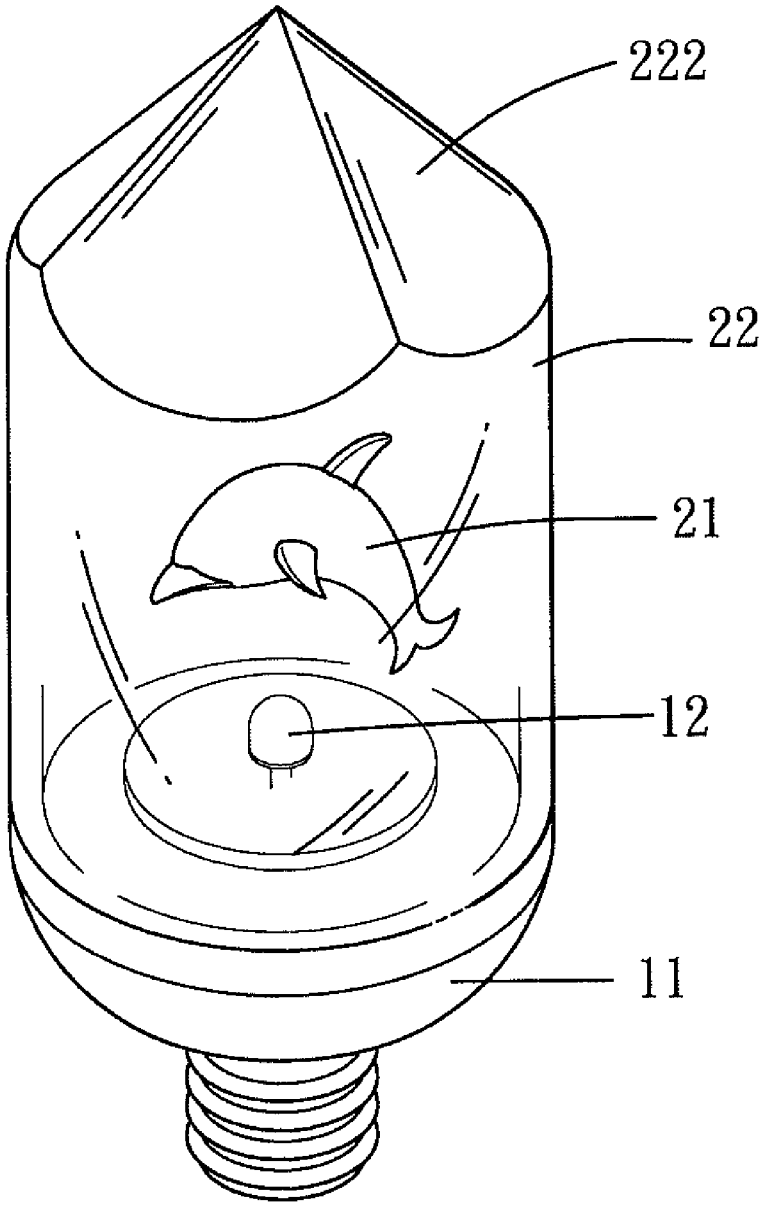
FIG. 4 is a stereogram showing a second embodiment of the present invention.
Figure 5:
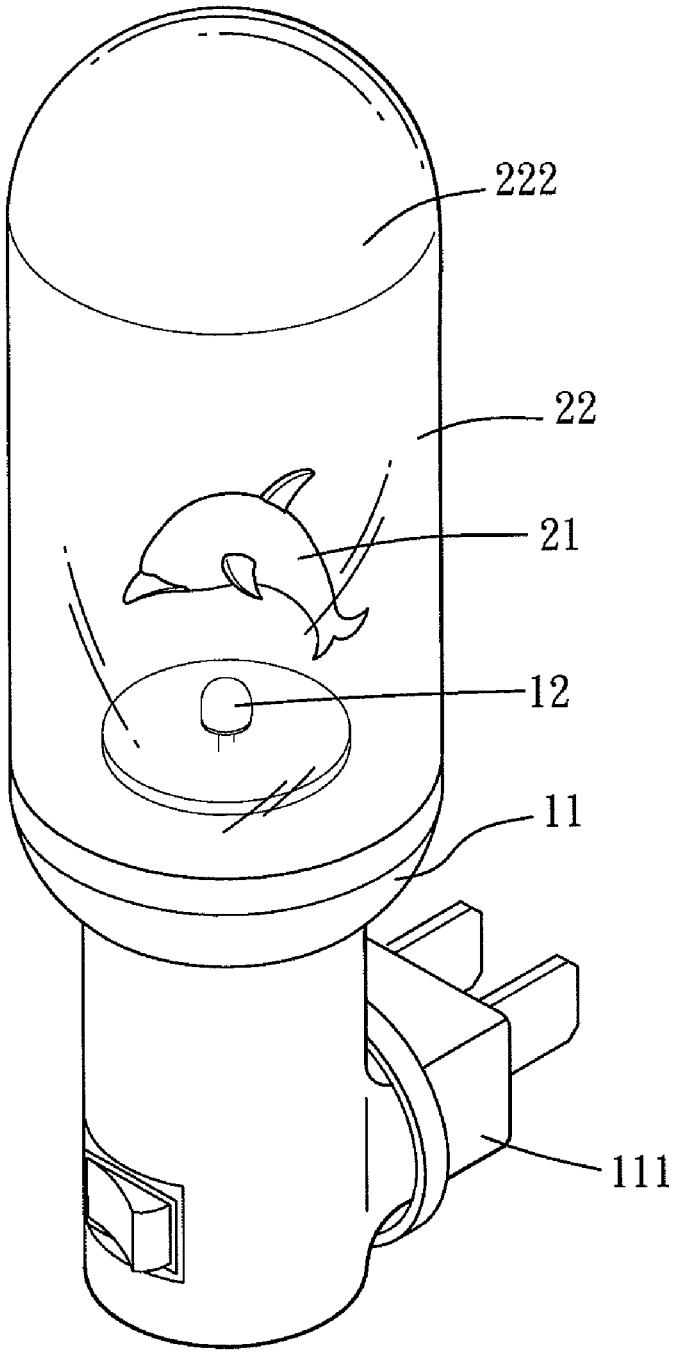
FIG. 5 is a combination drawing showing a third embodiment of the present invention.

In addition, an outer surface of the covering layer 22 includes at least a side surface 221 and an end surface 222. The side surface 221 is located between the end surface 222 and the luminary base 11. The side surface 221 may be a cylindrical surface. Preferably, a central axis defined by the side surface 221 is parallel to the axis defined by the luminary 12. The end surface 222 may be a conical surface. Preferably, the end surface 222 has a central axis parallel to the axis defined by the luminary 12. In a second embodiment of the present invention, the end surface 222 may include one or more than one planar surfaces, as shown in FIG. 4. Preferably, the planar surfaces are inclined to the axis defined by the luminary 12. In a third embodiment of the present invention, the end surface 222 may be a hemispherical surface, as shown in FIG. 5. As such, the side surface 221 may have a refractive power different from that of the end surface 222. The model 21 may be shown up with different appearances by the side surface 221 and by the end surface 222.

The connecting portion 3 includes a threaded portion 31 and a conjunction portion. The conjunction portion is designed for scalable. The conjunction portion and the holder 11 are electrically connected with the threaded portion 31 respectively. The conjunction portion is located between a bottom end of the threaded portion 31 and the lamp adapter 111 which is able to be connected to the socket. The threaded portion 31 is able to be screwed with the lamp adapter 111. In the present embodiment, the conjunction portion includes a leaf 33, as shown in FIG. 1A. The leaf 33 is disposed on the bottom end of the threaded portion 31. The leaf 33 is flexible and conductive. As such, when the threaded portion 31 is received in a lamp adapter by screwing, the position of the lamp is able to be adjusted by rotating the lamp. At the same time, the conjunction portion is able to be electrically connected with the lamp adapter continuously. The electric power received from the lamp adapter will not be broken.

Figure 6:
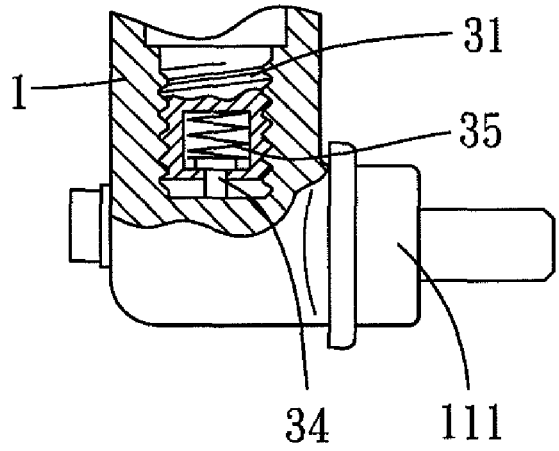
FIG. 6 is a partial profile showing a fourth embodiment of the present invention.
Figure 7:
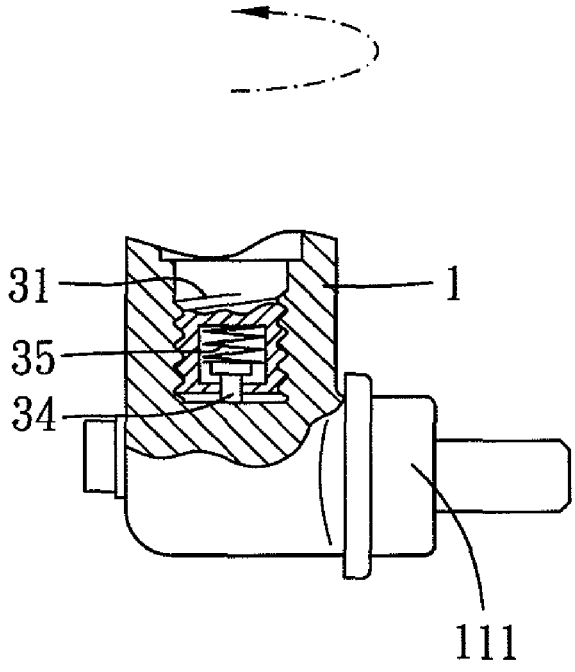
FIG. 7 is a partial profile showing a fourth embodiment of the present invention.

Please refer to FIG. 6 and FIG. 7. In a fourth embodiment of the present invention, the conjunction portion includes a conductive rod 34 and an elastic member 35. A bottom end of the conductive rod 34 protrudes from the bottom end of the threaded portion 31. The elastic member 35 elastically abuts against the conductive rod 34, so that the bottom end of the conductive rod 34 has a tendency to protrude from the bottom end of the threaded portion 31. In other words, the conductive rod 34 and the elastic member 35 are co-operated to achieve the scalable purpose.

To conclude, a smooth outer surface can be provided with the covering layer, so that the lamp can be cleaned up easily. At the same time, patterns or sculptures can be provided with the model. The model is protected by the covering layer to avoid crashing and oxidizing. In addition, position of the lamp is able to be adjusted by rotating the lamp. By the scalable conjunction portion, electric power supply will not be broken when the position is adjusted.

What is claimed is:

1. A stylable lamp with bulb including model, comprising:

a luminous base, comprising a holder and a luminary, the luminary being disposed on the holder, the luminary being adapted for electric power received from the holder to drive so as to illuminate light along an axis;

a bulb, disposed on the holder, the luminary being substantially enclosed by the holder and the bulb, the bulb comprising a model and a covering layer which are both solid, the model being embedded in the covering layer, the covering layer being made of transparent material, the model having an optical property different from an optical property of the covering layer;

a connecting portion, comprising a threaded portion and a conjunction portion, the conjunction portion being scalable, the conjunction portion and the holder being electrically connected with the threaded portion respectively, the conjunction portion being located between a bottom end of the threaded portion and a lamp adapter which is able to be connected with a socket, the threaded portion is able to be screwed with the lamp adapter.

2. The stylable lamp with bulb including model of claim 1, wherein an outer surface of the covering layer comprises at least a side surface and an end surface, the side surface is located between the end surface and the luminary base, the side surface is a cylindrical surface, the end surface is a planar surface.

3. The stylable lamp with bulb including model of claim 2, wherein the end surface is inclined to the axis.

4. The stylable lamp with bulb including model of claim 2, wherein the side surface has a central axis parallel to the axis.

5. The stylable lamp with bulb including model of claim 1, wherein an outer surface of the covering layer comprises at least a side surface and an end surface, the side surface is located between the end surface and the luminary base, the side surface is a cylindrical surface, the end surface is a conical surface.

6. The stylable lamp with bulb including model of claim 5, wherein the end surface has a central axis parallel to the axis.

7. The stylable lamp with bulb including model of claim 5, wherein the side surface has a central axis parallel to the axis.

8. The stylable lamp with bulb including model of claim 1, wherein the bulb is rotatable about the axis with respect to the holder.

9. The stylable lamp with bulb including model of claim 1, wherein the conjunction portion comprises a leaf, the leaf is disposed on the bottom end of the threaded portion.

10. The stylable lamp with bulb including model of claim 1, wherein the conjunction portion comprises a conductive rod and an elastic member, a bottom end of the conductive rod protrudes from the bottom end of the threaded portion, the elastic member elastically abuts against the conductive rod, so that the bottom end of the conductive rod has a tendency to protrude from the bottom end of the threaded portion.

* * * * *